United States Patent [19]

Kinzalow

[11] Patent Number: 5,034,676

[45] Date of Patent: Jul. 23, 1991

[54] DIRECT CURRENT POWER SUPPLY CIRCUIT HAVING AUTOMATIC LINEAR AND SWITCHING MODES

[76] Inventor: Richard L. Kinzalow, 215 N. Lincoln Ave., Park Ridge, Ill. 60068

[21] Appl. No.: 464,167

[22] Filed: Jan. 12, 1990

[51] Int. Cl.[5] ..... G05F 1/56

[52] U.S. Cl. ..... 323/268; 323/274; 323/284

[58] Field of Search ..... 323/268, 269, 270, 271, 323/272, 273, 274, 275, 282, 284, 285, 299, 303

[56] References Cited

U.S. PATENT DOCUMENTS

| | | | |
|---|---|---|---|
| 3,670,233 | 6/1972 | Zellmer et al. | 323/17 |
| 3,781,653 | 12/1973 | Marini | 323/17 |
| 3,983,473 | 9/1976 | Sanderson | 323/274 |
| 4,242,629 | 12/1980 | Shuey | 323/17 |
| 4,350,948 | 9/1982 | Meroni | 323/282 |
| 4,413,224 | 11/1983 | Krupka et al. | 323/222 |
| 4,502,152 | 2/1985 | Sinclair | 323/268 |
| 4,575,673 | 3/1986 | Tedeschi et al. | 323/351 |
| 4,592,818 | 6/1986 | Cavil et al. | 204/196 |
| 4,644,255 | 2/1987 | Freymuth | 323/282 |
| 4,683,415 | 7/1987 | Zimmerman | 323/282 |

FOREIGN PATENT DOCUMENTS

| | | | |
|---|---|---|---|
| 0204928 | 12/1982 | Japan | 323/268 |
| 0213262 | 10/1985 | Japan | 323/268 |
| 0798765 | 1/1981 | U.S.S.R. | 323/268 |

*Primary Examiner*—Peter S. Wong
*Attorney, Agent, or Firm*—McCaleb, Lucas & Brugman

[57] ABSTRACT

A direct current power supply circuit converts an unregulated direct current input source such as an automobile battery to a regulated direct current output voltage for a device such as a mobile telephone requiring a fixed operating voltage. The circuit has an improved input to output voltage rating of less than two volts, enabling it to supply a load reliably with direct current power from an unregulated direct current source as low as ten volts. The circuit operates in a linear mode at low power levels and in a switching, pulse width modulated mode at higher output power levels. The circuit employs a three-terminal linear voltage regulator as a control element. It has input, output, and ground pins and is effective in response to current input through the input pin to maintain a predetermined, fixed voltage differential between the output and ground pins. In the example disclosed, the linear voltage regulator maintains a 5-volt differential between the output and ground pins. To provide fixed, stable 8-volt output, the circuit maintains a 3-volt potential at a reference junction connected to the ground pin. The linear voltage regulator seeks to maintain the 5-volt differential to thereby hold eight volts at the output pin. For high power requirements beyond the capacity of the linear voltage regulator, the circuit automatically varies the voltage at the reference junction to provide power pulses to the output of width and frequency required by the load.

12 Claims, 2 Drawing Sheets

DIRECT CURRENT POWER SUPPLY CIRCUIT HAVING AUTOMATIC LINEAR AND SWITCHING MODES

BACKGROUND OF THE INVENTION

The field of the present invention is generally that of a voltage regulating power supply circuit inputting electric power from a variable voltage DC source such as an automobile battery and outputting power at a fixed, stable voltage to a device such as a portable telephone, video camera, or CD player.

The SAE range of an automobile alternator is 16.2 to 10.8 volts. For best results, a car phone needs a fixed, stable DC source, at, say, 8 volts, ripple-free to minimize unwanted background noise.

To get the most possible use from a battery, the voltage regulating power supply must function as far down in the 16.2–10.8 volts range as possible. A disadvantage of a conventional power supply has been that it will not function with an input to output voltage drop of much less than 3½ volts. This means it will not provide the required 8-volt output if the battery voltage drops below 11½ volts. Further at a load of one ampere, heat dissipation in the order of 3½ watts can become a serious problem in a compact assembly with miniaturized chip components.

SUMMARY OF THE INVENTION

It is a principal object of the present invention to provide a voltage regulating power supply circuit which has a greatly improved input-to-output voltage of less than two volts and which has greatly improved efficiency dissipating in the order of one watt at full load.

Another object of the present invention is to provide a voltage regulating power supply circuit which operates in a linear mode at low loads and automatically converts to a pulse-modulated, switching mode at high loads.

BRIEF DESCRIPTION OF THE DRAWING

Other objects and advantages will be apparent from the accompanying drawing in which.

Like parts are designated by like reference numerals throughout the figures.

DESCRIPTION OF THE PREFERRED EMBODIMENT

Figure 1:
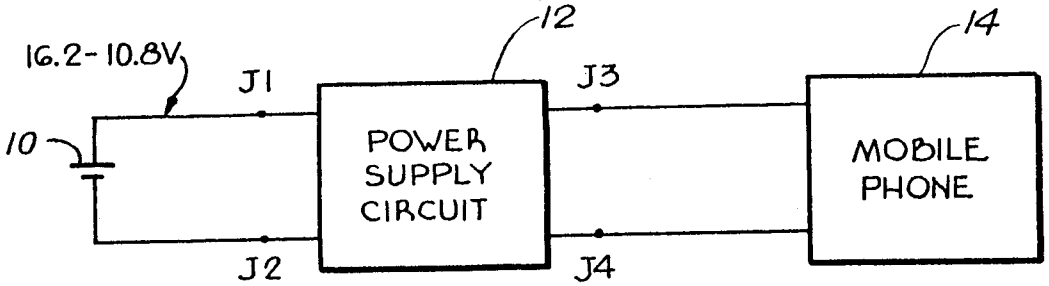
FIG. 1 shows one specific example, without limitation thereto, of one practical application of this invention.

Referring now in more detail to the preferred embodiment illustrated in the drawing, FIG. 1 illustrates one specific application applied to a mobile car telephone in which the voltage regulating power supply circuit of the present invention is generally designated 12. It is connected by input power and ground terminals J1 and J2 to a variable voltage source such as a car battery 10 and to a direct current operated device such as a mobile telephone 14 through output power and ground terminals J3 and J4.

The input voltage from the battery may vary from 16.2–10.8 volts inasmuch as this is the SAE—specified voltage range for automotive alternators. Typically, the output voltage will be fixed at some stable DC voltage, for example 8 volts as illustrated.

It should be emphasized that mobile telephone service is merely one example of the present invention. Other examples, without limitation thereto, are portable CD players and video cameras.

Figure 2:
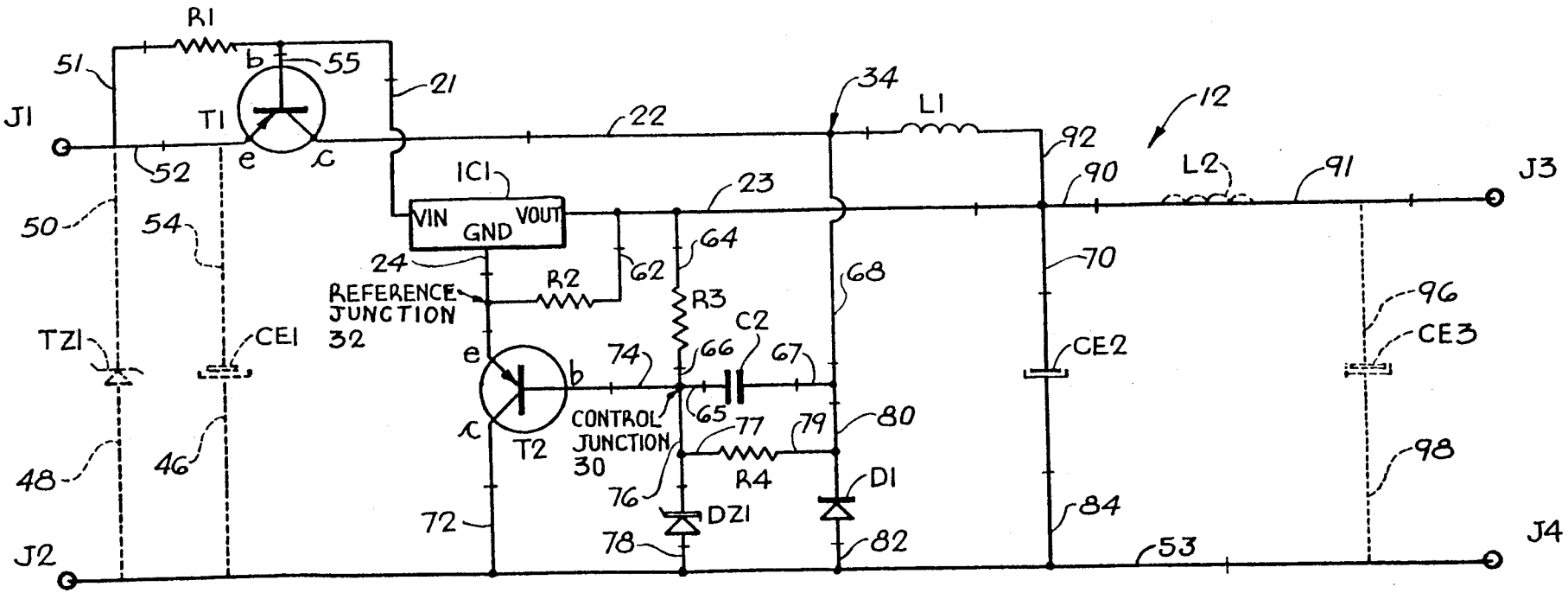
FIG. 2 is a circuit diagram of a voltage regulating power supply circuit illustrating a preferred form of the present invention.

Referring now to FIG. 2, the basic circuit is shown in solid lines. The four components shown in broken lines protect the circuit from overvoltages that may occur from some DC sources, and smooth out minuscule output ripples which may be needed for telephone service but may not be essential for other, less stringent applications.

The common or ground line 53 between J2 and J4 is connected to an input surge suppressor zener TZ1 through line 48, to an input filter capacitor CE1 through line 46, to the collector of a voltage offset transistor T2 through line 72, to the positive side of a voltage offset reference zener DZ1 through line 78, to the positive side of a flyback diode D1 through line 82 and to switching filter capacitors CE2 and CE3 through lines 84 and 88 respectively.

The positive voltage input J1 is connected through line 50 to the input surge suppressor TZ1, to input filter capacitor CE1 through line 54, to the emitter of a main pass power transistor T1 through line 52, and to an emitter base biasing resistor R1 through line 51.

A linear voltage regulator IC1 has its input pin $V_{in}$ connected to the base of transistor T1 through lines 55 and 21 and has its ground pin GND connected to the emitter of voltage offset transistor T2 through line 24. The output pin $V_{out}$ is connected to the collector of T1 through line 23, an inductor L1, and line 22, and is connected to the positive output terminal J3 through lines 23 and 90, inductor L2, and line 91. Electrolytic capacitor CE2 is connected between lines 90 and 53, and electrolytic capacitor CE3 is connected between lines 91 and 53. A biasing resistor R2 is connected between pins GND and $V_{out}$ in line 62. $V_{out}$ is also connected to a biasing resistor R3.

The base of transistor T2 and a capacitor C2 are connected through lines 74 and 65 to a common central junction 30 which, in turn, is connected to resistor R3 through line 66 and to resistor R4 and the negative side of zener diode DZ1 through lines 76 and 77. Resistor R4 and capacitor C2 are connected in parallel to one another and to diode D1 and inductor L1 by means of lines 77,79 and 65,67.

As a further detailed disclosure of the circuit shown in FIG. 2, the following specific components have been highly satisfactorily in the circuit shown in FIG. 2:

IC1—Motorola Linear Voltage Regulator No. LM2931A2
T1—Power Transistor T1P42A
T2—Voltage Offset Transistor PN2907
TZ1—Zener Diode IN6289A
DZ1—Zener Diode IN4372A
D1—Flyback Diode UES1102
CE1—Electrolytic Filter Capacitor 47/25
CE2 & CE3—Electrolytic Filter Capacitor 220/-16
L1 & L2—Inductors 47uH
C2—Capacitor 270pF R1—Resistor 15 ohms
R2 & R3—Resistor 1K ohms
R4—Resistor 15K ohms An important feature of the linear voltage regulator ICl is that it maintains a constant voltage difference between pins GND and $V_{out}$. Specifically, for the Type LM 2931A2 illustrated, under normal operating conditions, it seeks to maintain a 5-volt differential between pins GND and $V_{out}$. Components T2, R2, R3 and DZ1 maintain an artificial reference voltage of 3 volts DC on pin GND, thereby normally offsetting the linear voltage regulator IC1 and keeping about 3+5=about 8 volts on pin $V_{out}$ and on output line 23.

To maintain the constant 5-volt differential between pins GND and $V_{out}$, IC1 draws power from its input pin $V_{in}$.

The resistor R3 provides a constant current to zener DZ1 which in turn provides base drive current for T2.

At very low loads, IC1 becomes unstable. Because of this, resistor R2 provides a load for transistor T2. At light loads, the output from $V_{out}$ into line 23 is filtered by the large capacitors CE2 and CE3 and inductor L2 providing a very stable low-noise output at output terminals J3 and J4.

As the output current requirement at terminal J3 increases, the voltage regulator IC1 will require more current from its input pin $V_{in}$. As that input current increases, the voltage across R1 increases. When it exceeds about 0.7 volts, the base of T1 begins to conduct. The base current is multiplied by the beta characteristic (about 100×) of T1 causing it to become conductive. Collector current flows through lines 22 and 23, raising the output voltage at output pin $V_{out}$ and J3. This also raises the offset voltage through R4 at control junctions 30, forcing both IC1 and T2 to go into full conduction mode for a short period of time providing added output current to J3 through the inductors L1 and L2.

As the voltage at output pin $V_{out}$ increases, or starts to increase, above 8 volts, IC1 will automatically react to reduce that voltage by requiring less current through input pin $V_{in}$. This reduces the voltage across R1 to less than 0.7 volts to the point where T1 turns off. Current flow in conductor 22 stops. When this happens, the stored energy in inductor L1 reverses voltage thereby forward-biasing the commutating or flyback diode D1, and charging switching filter capacitor CE2. During this time diode D1 is conducting, R4 and C2 are lowering the offset voltage at control junction 30 thereby causing IC1 to remain off for a short period of time.

Thus, at low output loads at J3 and J4, IC1 operates in a linear mode causing a steady DC current to flow through conductors 23, 90 and 91 to J3. Under such low load direct current conditions, L2 generates no impedance.

Figures 3A, 3B:
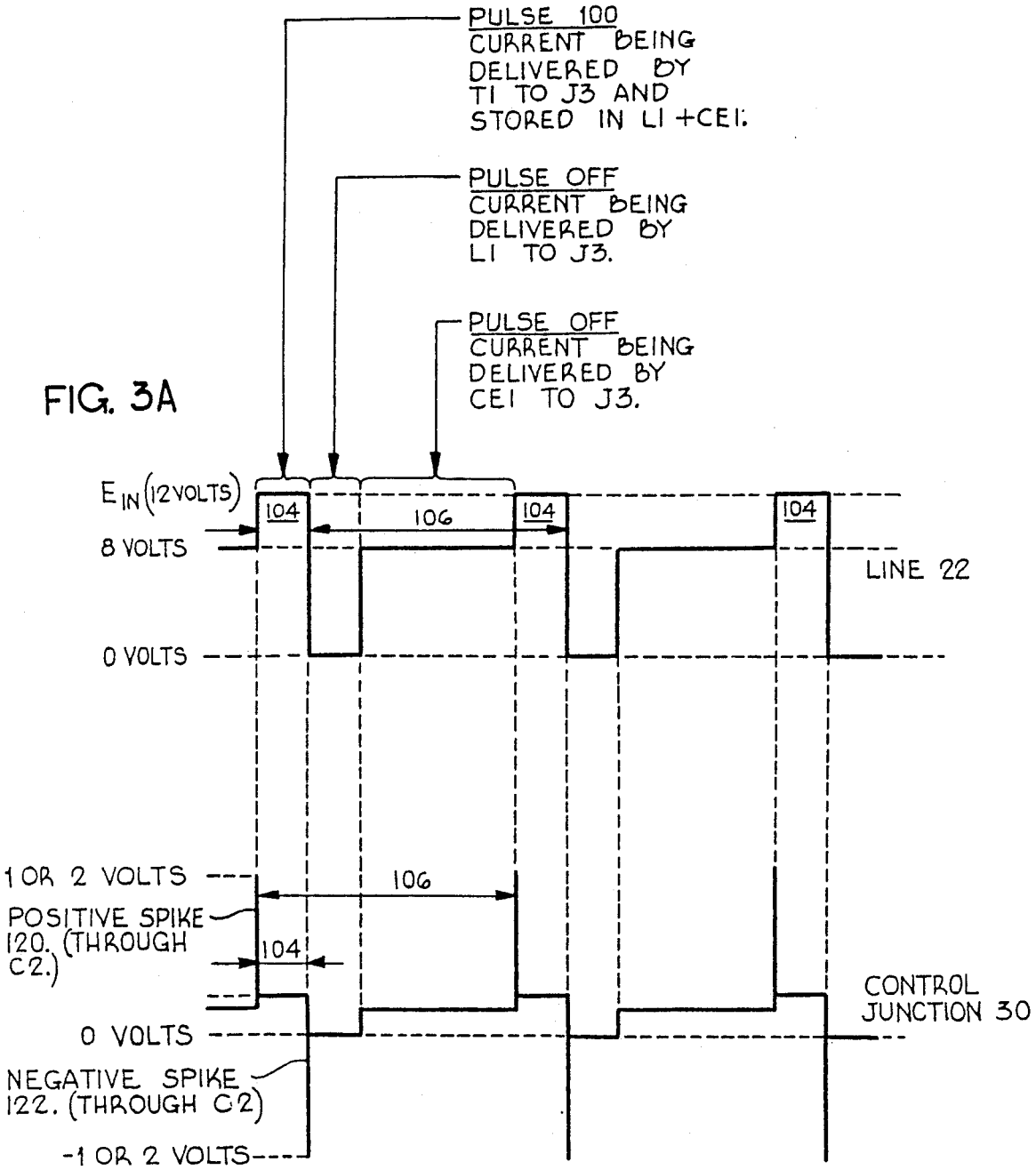
FIG. 3A illustrates a typical pulse type wave form generated in part of the circuit during the switching mode.
FIG. 3B illustrates a wave form generated in another part of the circuit during the switching mode.

At high output loads, the power supply circuit 12 functions in a switching mode, generating a square wave form signal 104 in line 22. As shown in FIG. 3A, signal 104 is a series of $E_{in}$-volt pulses with pulse-width and frequency meeting the power requirements at J3.

The size of resistor R4 determines the amount of hysteresis in the circuit when in switching mode. The size of capacitor C2 determines the ratio of on/off time of the circuit in the switching mode.

Use and operation in both linear and pulse-modulated switching modes will now be described.

Linear Mode

When the load requirement at J3 is less than about 40 milliamperes in the particular circuit shown, the circuit is in the linear mode, through IC1 only, because the voltage drop across R1 is insufficient to turn T1 on. The maximum capacity of IC1 is about 100 milliamperes through $V_{out}$. It has about a 10% "overhead", so about 110 milliamperes would enter $V_{in}$ and 10 milliamperes would flow out through GND.

For purposes of the present description, assume at start-up J1 is connected to the positive post of a 12-volt-rated battery and $V_{in}$ is 12 volts with reference to the ground. $E_{in}$ would also be 12 volts. Assume further that $V_{out}$ will be 8.1 volts. (Details in the following discussion will prove this assumption.) Because the output at $V_{out}$ is direct current, it will be unaffected by L2, and lines 23, 62, 64, 70, 90, 91, and output terminal J3 will also be 8.1 volts.

This provides a current through R3 and DZ1 to ground line 53 between J2 and J4. DZ1, when reversed-biased, conducts at about 2.5 volts and above. This applies a reference voltage of 2.5 volts to control junction 30 and to the base of T2. The emitter of T2 is about 0.6 volts higher, more positive than the base, making the voltage at reference junction 32 about 3.1 volts.

Thus, the 2.5 volt drop across DZ1 provides a reference or offset voltage of about 3.1 at reference junction 32 and at GND. Inasmuch as IC1 seeks to maintain the 5-volt differential mentioned between $V_{out}$ and GND it will therefore provide the 8.1 volts in line 23 assumed above at the start of this discussion.

Alternatively, if IC1 is required to provide ten volts in line 23, instead of eight as described in the example given, DZ1 would have to provide a 4.5 volt drop. This would provide 4.5 volts at the base and emitter of T2, and the normal 0.6 voltage drop between the emitter and collector would be additive and provide an approximately 5-volt reference voltage at GND. This would be additive to the 5-volt differential between GND and $V_{out}$, providing ten volts in line 23.

Switching Mode

For output load requirements at J3 beyond the capacity of IC1, the circuit automatically converts to switching mode with additional power flowing in a series of pulses 104 from T1 to J3 via main power line 22.

Assume for this description of the switching mode that the load requirement at J3 is one ampere, which is far more than the 100 milliamperes capacity of IC1. Also assume, as before, that the voltage $E_{in}$ at J1 is 12.

When the current through R1 reaches about 40 milliamperes, T1 starts to conduct. Current starts to flow into line 22. This is a change of state involving build-up of a magnetic field in L1 which opposes that change of state. As the field rapidly builds up around L1, a back e.m.f. voltage rapidly rises across L1. This rapidly rising voltage is coupled through C2 to the control junction 30 and the base of T2. C2 is a relatively small capacitor and transmits a quick, sharp positive voltage spike 120 of 1 or 2 volts, or more, as shown in FIG. 3B, to the base of T2.

The instant this increased voltage spike 120 reaches control junction 30 it correspondingly raises the voltage at reference junction 32 which increases momentarily from 3.1 volts to a voltage considerably higher, for example, as much as 5 volts or more.

When the voltage at reference junction 32 and GND increases to, say 5 volts, there will be an instantaneous decrease in the voltage differential between $V_{out}$ and GND. There will be only 3 volts differential between the approximately 8 volts maintained at $V_{out}$ by CE2, and the 5 volts at GND. This sudden, substantial drop in differential between $V_{out}$ and GND, to 3 volts, will turn IC1 on to its full capacity of about 100 milliamperes in an attempt to restore the normal 5-volt differential between $V_{out}$ and GND. This sudden, full turn-on of IC1 increases the current through R1 and, in turn, suddenly turns T1 fully on. At this instant, both IC1 and T1 are fully conductive, pouring current into J3 at their maximum capacities.

Referring now to the small resistor R4 which parallels C2, this furnishes a small bias, a few millivolts, on the control junction 30 and at the base of T2.

As IC1, now turned fully on, begins to sense approach of its goal of 5 volts between $V_{out}$ and GND, it starts to shut down. As it starts to do so, it reaches a point (around 40 milliamperes through $V_{out}$) where T1 also starts to shut down. When it does, the current through L1 starts to decrease. Again, because L1 is an inductor, it resists this change of current. Its collapsing magnetic field generates a reverse voltage across L1. This sends a very substantial negative spike 122 (FIG. 3B) of 1 or 2 volts, into junction 34 and conductors 68 and 80. This strong, instantaneous negative spike starts D1 to conduct, only 0.6 volts being needed for this.

This negative-going spike 122 is coupled back through C2 and control junction 30 to the base of T2. This will cause T2 to conduct and draw down the charge on GND to a full negative state. This wipes out the positive charge on GND, causing IC1 suddenly to sense an 8.1 voltage differential between $V_{out}$ and GND. IC1 immediately shuts down and, in turn, shuts down T1 completely.

FIGS. 3A and 3B show the positive and negative spikes 120 and 122 with a short time interval representing the width of pulse 104 between them. Total cycle time is indicated by the numeral 106 in FIGS. 3A and 3B. In the switching mode, power is taken from the battery 10 only during the pulse 104.

Again referring to FIGS. 3A and 3B, the actual input of current during the pulse 104 comprises only a minor part of the duration of the whole cycle 106. Although FIGS. 3A and 3B are not necessarily to any particular scale, they indicate that the duration of the pulse 104 may be only one-fifth of the full cycle 106. If the load called for is 1 ampere at J3, for example, the pulse 104 may have an intensity of 5 amperes but only for one-fifth of the time, thereby averaging out to one ampere for the full cycle 106.

Again referring to FIG. 3A, energy is delivered in the switching mode from T1 to J3 during portions of this full cycle 106 as follows:

(1) First, energy is delivered to the output terminal J3 during the pulse 104. This comes through T1 at a voltage level of $E_{in}$ as shown in FIG. 3A and lasts for the time of pulse 104.

(2) Second, at the end of the pulse 104, energy previously stored in L1 during the pulse is transmitted to J3 and the magnetic field around L1 collapses.

(3) Third, energy stored in CE2 and CE3 is transmitted to J3.

The components are sized to enable J3 to receive only a smooth DC current with an inconsequential ripple. A purpose of L1 and CE2 in the sizes given, is to reduce unwanted oscillations in line 92 to about 50 millivolts. L2 and CE3 further reduce the ripple to 10 millivolts, this being especially useful where the circuit is used for telephone service as described.

The embodiment described and shown to illustrate the present invention has been necessarily specific for purpose of illustration. Alterations, extensions and modifications would be apparent to those skilled in the art. The aim of the appended claims, therefore, is to cover all variations included within the spirit and scope of the invention.

The embodiments of the invention in which an exclusive property or privilege is claimed are defined as follows:

1. A direct current power supply for converting an unregulated direct current input voltage into a regulated direct current output voltage comprising:

(a) input and output terminals and a reference terminal;

(b) first means coupled to said output and reference terminals and responsive to a current demand below a predetermined current value to direct current to said output terminal in a linear mode;

(c) input control means coupled to said input terminal, said first means and said output terminal, said input control means responsive to current flow from said input terminal below said predetermined current value to direct substantially all of said input current to said first means and responsive to current flow from said input terminal above said predetermined current value to direct a variable portion of said input current directly to said output terminal;

(d) wherein said input control means comprises a semiconductor device having electron emitting, electron collecting and control electrodes and a resistor coupled between said input terminal and said control electrode, said electron emitting electrode being coupled to said input terminal and said electron collecting electrode being coupled to said output terminal.

2. A direct current power supply as set forth in claim 1 wherein said first means includes a reference voltage terminal and an output terminal, further including second means coupled between said reference voltage terminal and said reference terminal to maintain a predetermined reference voltage on said reference voltage terminal.

3. A direct current power supply as set forth in claim 2 wherein said second means includes means responsive to said current flow from said input terminal above said predetermined current value to increase current flow from said first means to said output terminal, said input control means responsive to said current flow increase to increase said variable portion of said current, said first means responsive to said increase of current flow above a predetermined value to decrease current flow therethrough and in said input control means to substantially cut off said input current.

4. A direct current power supply as set forth in claim 2 wherein said second means includes a second semiconductor device having electron emitting, electron collecting and control electrodes, said electron emitting electrode of said second semiconductor device coupled to said reference voltage terminal of said first means and said electron collecting electrode of said second semiconductor device coupled to said reference terminal, a resistor coupled between said control electrode of said second semiconductor device and said output terminal of said first means, a zener diode coupled between said control electrode of said second semiconductor device and said reference terminal, the parallel combination of a resistor and a capacitor coupled between said control electrode of said second semiconductor device and said control electron collecting electrode of said first semiconductor device, a diode couple between said electron collecting electrode of said first semiconductor device and said reference terminal, a capacitor coupled between said output terminal of said first means and said reference terminal and an inductor coupled between said output terminal of said first means and said output terminal.

5. A direct current power supply as set forth in claim 1 wherein said first means is a linear voltage regulator.

6. A direct current power supply as set forth in claim 5 wherein said first means includes a reference voltage terminal and an output terminal, further including second means coupled between said reference voltage terminal and said reference terminal to maintain a predetermined reference voltage on said reference voltage terminal.

7. A direct current power supply as set forth in claim 6 wherein said second means includes means responsive to said current flow from said input terminal above said predetermined current value to increase current flow from said first means to said output terminal, said input control means responsive to said current flow increase to increase said variable portion of said current, said first means responsive to said increase of current flow above a predetermined value to decrease current flow therethrough and in said input control means to substantially cut off said input current.

8. A direct current power supply as set forth in claim 6 wherein said second means includes a second semiconductor device having electron emitting, electron collecting and control electrodes, said electron emitting electrode of said second semiconductor device coupled to said reference voltage terminal of said first means and said electron collecting electrode of said second semiconductor device coupled to said reference terminal, a resistor coupled between said control electrode of said second semiconductor device and said output terminal of said first means, a zener diode coupled between said control electrode of said second semiconductor device and said reference terminal, the parallel combination of a resistor and a capacitor coupled between said control electrode of said second semiconductor device and said control electron collecting electrode of said first semiconductor device, a diode couple between said electron collecting electrode of said first semiconductor device and said reference terminal, a capacitor coupled between said output terminal of said first means and said reference terminal and an inductor coupled between said output terminal of said first means and said output terminal.

9. A direct current power supply for converting an unregulated direct current input voltage into a regulated direct current output voltage comprising:

(a) input and output terminals and a reference terminal;

(b) first means coupled to said output and reference terminals and responsive to a current demand below a predetermined current value to direct current to said output terminal in a linear mode;

(c) input control means coupled to said input terminal, said first means and said output terminal, said input control means responsive to current flow from said input terminal below said predetermined current value to direct substantially all of said input current to said first means and responsive to current flow from said input terminal above said predetermined current value to direct a variable portion of said input current directly to said output terminal;

(d) wherein said first means includes a reference voltage terminal and an output terminal, further including second means coupled between said reference voltage terminal and said reference terminal to maintain a predetermined reference voltage on said reference voltage terminal;

(e) wherein said second means includes means responsive to said current flow from said input terminal above said predetermined current value to increase current flow from said first means to said output terminal, said input control means responsive to said current flow increase to increase said variable portion of said current, said first means responsive to said increase of current flow above a predetermined value to decrease current flow therethrough and in said input control means to substantially cut off said input current.

10. A direct current power supply as set forth in claim 9 wherein said first means is a linear voltage regulator.

11. A direct current power supply for converting an unregulated direct current input voltage into a regulated direct current output voltage comprising:

(a) input and output terminals and a reference terminal;

(b) first means coupled to said output and reference terminals and responsive to a current demand below a predetermined current value to direct current to said output terminal in a linear mode;

(c) input control means coupled to said input terminal, said first means and said output terminal, said input control means responsive to current flow from said input terminal below said predetermined current value to direct substantially all of said input current to said first means and responsive to current flow from said input terminal above said predetermined current value to direct a variable portion of said input current directly to said output terminal;

(d) wherein said first means includes a reference voltage terminal and an output terminal, further including second means coupled between said reference voltage terminal and said reference terminal to maintain a predetermined reference voltage on said reference voltage terminal;

(e) wherein said second means includes a second semiconductor device having electron emitting, electron collecting and control electrodes, said electron emitting electrode of said second semiconductor device coupled to said reference voltage terminal of said first means and said electron collecting electrode of said second semiconductor device coupled to said reference terminal, a resistor coupled between said control electrode of said second semiconductor device and said output terminal of said first means, a zener diode coupled between said control electrode of said second semiconductor device and said reference terminal, the parallel combination of a resistor and a capacitor coupled between said control electrode of said second semiconductor device and said control electron collecting electrode of said first semiconductor device, a diode couple between said electron collecting electrode of said first semiconductor device and said reference terminal, a capacitor coupled between said output terminal of said first means and said reference terminal and an inductor coupled between said output terminal of said first means and said output terminal.

12. A direct current power supply as set forth in claim 11 wherein said first means is a linear voltage regulator.

* * * * *